US005725692A

United States Patent [19]

DeLuca et al.

[11] Patent Number: 5,725,692

[45] Date of Patent: Mar. 10, 1998

[54] NICKEL BASE SUPERALLOY ARTICLES WITH IMPROVED RESISTANCE TO CRACK PROPAGATION

[75] Inventors: Daniel P. DeLuca, Tequesta; Charles M. Biondo, Jupiter; Howard B. Jones, Stuart; Chris C. Rhemer, Palm Beach Gardens, all of Fla.

[73] Assignee: United Technologies Corporation, Hartford, Conn.

[21] Appl. No.: 537,341

[22] Filed: Oct. 2, 1995

[51] Int. Cl.[6] ..... C22C 19/05

[52] U.S. Cl. ..... 148/410; 148/404; 60/909

[58] Field of Search ..... 148/404, 410, 148/428, 429; 60/909

[56] References Cited

U.S. PATENT DOCUMENTS

| | | | |
|---|---|---|---|
| 3,403,059 | 9/1968 | Barker et al. . | |
| 3,415,641 | 12/1968 | Ross . | |
| 3,536,542 | 10/1970 | Murphy et al. . | |
| 3,576,681 | 4/1971 | Barker et al. . | |
| 3,642,543 | 2/1972 | Owczarski et al. . | |
| 3,667,938 | 6/1972 | Boesch . | |
| 3,677,746 | 7/1972 | Lund et al. . | |
| 3,741,824 | 6/1973 | Duvall et al. . | |
| 3,748,192 | 7/1973 | Boesch . | |
| 3,915,761 | 10/1975 | Tschinkel et al. | 148/404 |
| 3,973,952 | 8/1976 | Bieber et al. . | |
| 4,083,734 | 4/1978 | Boesch . | |
| 4,253,884 | 3/1981 | Maurer et al. . | |
| 4,305,761 | 12/1981 | Bruch et al. . | |
| 4,379,120 | 4/1983 | Whitney et al. . | |
| 4,461,659 | 7/1984 | Harris | 148/404 |
| 4,512,817 | 4/1985 | Duhl et al. . | |
| 4,518,442 | 5/1985 | Chin . | |
| 4,676,846 | 6/1987 | Harf . | |
| 4,717,432 | 1/1988 | Ault . | |
| 4,795,507 | 1/1989 | Nazmy . | |
| 4,878,952 | 11/1989 | Pilloefer . | |
| 4,957,567 | 9/1990 | Krueger et al. . | |
| 5,047,091 | 9/1991 | Khan et al. . | |
| 5,061,324 | 10/1991 | Keh-Minn Chang . | |
| 5,100,484 | 3/1992 | Wukusick et al. . | |
| 5,143,563 | 9/1992 | Krueger et al. | 148/410 |
| 5,328,659 | 7/1994 | Tillman et al. | 420/448 |
| 5,413,752 | 5/1995 | Kissinger et al. | 419/28 |

FOREIGN PATENT DOCUMENTS

| | | | |
|---|---|---|---|
| 0274631 | 11/1987 | European Pat. Off. | C22F 1/10 |
| 3731598 | 6/1988 | Germany | 148/410 |
| 2284617 | 6/1995 | United Kingdom | C22F 1/10 |

OTHER PUBLICATIONS

D. P. DeLuca, R. W. Hatala "Single Crystal PWA 1472 in High Pressure Hydrogen" 10 pgs.

The Effect of Internal Hydrogen on a Single–Crystal Nickel–Base Superalloy, W.S. Walston, I.M. Bernstein and A.W. Thompson, Metallurgical Transastions A, vol. 23A, Apr. 1992, pp. 1313–1322.

Journal of Materals Science; 29 (1994) 2445–2458.

Metallurgical Trans A 3 2157–2162, Aug. 1972.

Metal Alloys Index 92(2):31–885, Feb. 1972.

Metal Alloys Index 94 (3): 31–1378, Mar. 1994.

DeLuca et al; Superalloys 718, 625. 706 Var Deriv., Proc. Int. Symp., 3rd (1994), 817–26.

*Primary Examiner*—David A. Simmons

*Assistant Examiner*—Margery S. Phipps

*Attorney, Agent, or Firm*—Brooks, Haidt, Haffner & Delahunty

[57] ABSTRACT

The present invention relates to a heat treated, gamma prime precipitation strengthened nickel base alloy having an improved resistance to hydrogen embrittlement, particularly crack propagation. The alloy has a microstructure which is essentially free of script carbides, gamma—gamma prime eutectic islands and porosity. The microstructure further includes a plurality of regularly occurring large barrier gamma prime precipitates and a continuous field of fine cuboidal gamma prime precipitates surrounding the large barrier gamma prime precipitates.

6 Claims, 4 Drawing Sheets

4,600X

200X

200X 4,600X

200X

200X 4,600X

NICKEL BASE SUPERALLOY ARTICLES WITH IMPROVED RESISTANCE TO CRACK PROPAGATION

The contents of Nickel Base Superalloy Columnar Grain and Equiaxed Materials with Improved Performance in Hydrogen and Air, U.S. Ser. No. 08/539,091, which is a continuation-in-part of U.S. Ser. No. 08/284,727, now abandoned, which is a continuation of U.S. Ser. No. 08/075,154, now abandoned, all of common assignee herewith, are incorporated herein by reference to the extent that the contents do not differ from U.S. Ser. No. 08/284,727.

BACKGROUND OF THE INVENTION

1. Technical Field

This invention relates to high strength nickel base superalloys possessing superior resistance to crack propagation, especially under conditions where hydrogen embrittlement is prone to occur. This invention also relates to heat treatments for such alloys.

2. Background Information

This invention focuses on improvements to the hydrogen embrittlement resistance of high strength nickel base superalloy materials. High strength nickel base superalloys are defined in the context of this invention as nickel base alloys having more than about fifty volume percent of the strengthening gamma prime phase in a gamma matrix and having a yield strength in excess of about 100 ksi (690 MPa) at 1000° F. (538° C.). The gamma prime phase typically assumes a cuboidal morphology in the gamma matrix with alignment in the <001> direction. Such alloys find their widest application in the field of gas turbine engines.

In gas turbine engines, hydrocarbon fuels are burned, and free hydrogen may be present at some points during the combustion process, but the relatively low concentration of available hydrogen, and the operating conditions of such engines, have not been found to cause any significant hydrogen embrittlement of the nickel base superalloys.

Hydrogen embrittlement is more frequently encountered in fields other than those relating to the gas turbine industry. For example, hydrogen embrittlement occurs at times during electroplating, where hydrogen gas is generated on the surface of a part being plated and is absorbed into the part, greatly reducing the ductility of the part. It is also a factor in some forms of hot corrosion, especially hot corrosion which is observed in well drilling wherein deep drilled oil well casings are prone to hydrogen embrittlement as a result of the hydrogen sulfide present in some of the crude petroleum and natural gas which pass through the casings. U.S. Pat. Nos. 4,099,922, 4,421,571 and 4,245,698 are typical of the attempts to solve oil well hydrogen embrittlement problems.

Recently, in the development of the space shuttle main engines, hydrogen embrittlement has been recognized as a potential problem. The space shuttle main engines are rocket engines which mix and react liquid hydrogen and liquid oxygen to form the propellant. These reactants are pumped into the main combustion chamber by turbo pumps which are powered by the combustion products of the reaction of hydrogen and oxygen. The hot side of the turbo pumps, which is exposed to the combustion products of the hydrogen/oxygen reaction, includes a multiplicity of small turbine blades which are typically investment cast from directionally solidified Mar-M246+Hf alloy, an alloy which meets the previous definition of a high strength nickel base superalloy in that it contains more than fifty volume percent of the gamma prime phase and has a yield strength of more than 100 ksi (690 MPa) at 1000° F. (538° C.). The nominal composition of Mar-M246+Hf, in weight percent, is 9 Cr, 10 Co, 2.5 Mo, 10 W, 1.5 Ta, 5.5 Al, 1.5 Ti, 1.5 Hf, balance nickel. Due to this hydrogen exposure, hydrogen embrittlement of these turbine blades, as well as other articles in the turbo pumps such as vanes, is of great concern.

Hydrogen embrittlement is encountered in these and other circumstances, and while the exact mechanism involved is still open to conjecture, the existence of the problem is well documented. Initiation of hydrogen embrittlement cracking in nickel base superalloys has been found to occur at discontinuities in the structure, such as pores, hard particles and interfaces between precipitated phases and the matrix, such as script type carbides and gamma—gamma prime eutectic islands. Specifically, during testing fatigue crack initiation has been observed at similar sites in conventionally processed PWA 1489, which is a high strength, equiaxed superalloy having a nominal composition of 8.4 Cr, 10 Co, 0.65 Mo, 5.5 Al, 3.1 Ta, 10 W, 1.4 Hf, 1.1 Ti, 0.015 B, 0.05 Zr, balance Ni, with all quantities expressed in weight percent. Strong evidence has been observed for the occurrence of interphase cleavage at the interfaces between the gamma matrix and gamma prime particles, and within gamma—gamma prime eutectic islands. These features have been identified as fatigue crack initiation sites in this class of alloys in a hydrogen environment. Thus, there is great concern to minimize the initial occurrence of these crack initiation sites. There is also great concern to minimize crack propagation or growth should a crack develop.

Accordingly, there exists a need for a high strength nickel base superalloy material which is highly resistant to hydrogen embrittlement in general and particularly resistant to crack propagation.

DISCLOSURE OF THE INVENTION

According to the present invention, an improved, high strength nickel base superalloy material which is highly resistant to hydrogen embrittlement in general and particularly resistant to crack propagation is disclosed. The principles taught in this invention are also expected to provide marked increases in the fatigue resistance and crack propagation when used in more common applications, such as gas turbine engines.

Since the existence of such hard particles as carbides, nitrides and borides can be the source of fatigue crack initiation, the heat treatment process described herein is designed to solution essentially all of these hard particles, while leaving only enough of these particles in the grain boundaries to control grain growth in equiaxed alloys.

In the presence of hydrogen, eutectic islands provide crack initiation sites by cleaving at the interfaces of the gamma and gamma prime lamellae. Eliminating eutectic islands thus significantly retards cracking in the presence of hydrogen. Script carbides also provide fatigue crack initiation sites and, by minimizing their size and frequency of occurrence, fatigue life is also improved.

The invention process is applicable to nickel base superalloys in which gamma—gamma prime eutectic islands and script type carbide can be essentially completely solutioned without incurring incipient melting. In accordance with this invention, the alloy is a gamma prime strengthened nickel base alloy consisting essentially of the composition set forth in Table 1 (approximate wt. % ranges).

TABLE 1

| | (wt. %) | range | (wt. %) |
|---|---|---|---|
| Carbon | 0.006 | | 0.17 |
| Chromium | 6.0 | | 22.0 |
| Cobalt | — | | 15.0 |
| Molybdenum | — | | 9.0 |
| Tungsten | — | | 12.5 |
| Titanium | — | | 4.75 |
| Aluminum | — | | 6.0 |
| Tantalum | — | | 4.3 |
| Hafnium | — | | 1.6 |
| Iron | — | | 18.5 |
| Rhenium | — | | 3.0 |
| Columbium | — | | 1.0 |
| Nickel | remainder | | |

In a preferred embodiment, the gamma prime strengthened nickel base alloy consists essentially of the composition set forth in Table 2 (approximate wt. % ranges).

TABLE 2

| | (wt. %) | range | (wt. %) |
|---|---|---|---|
| Carbon | 0.13 | | 0.17 |
| Chromium | 8.00 | | 8.80 |
| Cobalt | 9.00 | | 11.00 |
| Molybdenum | 0.50 | | 0.80 |
| Tungsten | 9.50 | | 10.50 |
| Titanium | 0.90 | | 1.20 |
| Aluminum | 5.30 | | 5.70 |
| Tantalum | 2.80 | | 3.30 |
| Hafnium | 1.20 | | 1.6 |
| Iron | — | | 0.25 |
| Columbium | — | | 0.10 |
| Nickel | remainder | | |

One of ordinary skill in the art will recognize that various trace elements, including but not limited to, manganese, silicon, phosphorus, sulfur, boron, zirconium, bismuth, lead, selenium, tellurium, thallium and copper may be present in minor amounts.

The alloy of the present invention may be formed by providing a nickel base alloy as described above in molten form, casting the alloy in either an equiaxed or columnar grain form, and subjecting the alloy to a heat treatment. The alloy is heat treated (preferably, vacuum heat treated) using a stepped ramp cycle and subsequent hold to permit solutioning at a temperature approximately 50° F. (28° C.) above the gamma prime solvus temperature (temperature below which gamma prime exists) so that the gamma—gamma prime eutectic islands and the script type carbides are dissolved. Specifically, the ramp cycle includes the following: heat the superalloy article from room temperature to about 2000° F. (1093° C.) at about 10° F./minute (5.5° C./minute); ramp from about 2000° F. (1093° C.) to about 2240° F. (1227° C.) at about 2° F./minute (1.1° C./minute); ramp from about 2275° F. (1246° C.) to about 2285° F. (1252° C.) at about 0.1° F./minute (0.06° C./minute); and hold at about 2285° F. (1252° C.) for between about 3 hours to about 6 hours, preferably 4 hours.

If the alloy material was then rapid vacuum cooled from this point, fine gamma prime precipitates would occur and the material would exhibit significantly improved resistance to fatigue in hydrogen as well as in air.

Although the above process is extremely advantageous, it is also desirable to deter crack growth or propagation at any occurring cracks in the material. This would even further increase the useful life of a part/article made from the superalloy material. Accordingly, we have determined that the presence of large, barrier gamma prime precipitates in the microstructure would deter crack propagation by acting as crack arrestors. These large, barrier gamma prime precipitates may be precipitated out by slow cooling the superalloy material from between about 2350° F. (1288° C.) to about 2000° F. (1093° C.) at between about 0.1° F./minute (0.06° C./minute) and about 5° F./minute (2.8° C./minute), and most preferably from about 2285° F. (1252° C.) to about 2135° F. (1168° C.) at about 0.5° F./minute (0.28° C./minute). The material is then rapid vacuum cooled to room temperature and HIPped below the solvus temperature for a period of about four hours to eliminate all porosity, cavities, and voids. The material is then given conventional lower temperature heat treatments to produce a superalloy material which is resistant to crack initiation, as well as crack propagation.

An advantage of the present invention includes a gamma prime strengthened nickel base superalloy which is particularly resistant to crack propagation. The microstructure of this superalloy is characterized by an absence of intergranular eutectic gamma—gamma prime phase islands, an absence or low incidence of large script type carbides and an absence or low incidence of linear carbides spanning grains. The microstructure also includes a plurality of regularly occurring large barrier gamma prime precipitates elongated in the <111> family of crystallographic directions (8<111> vectors in total) and a continuous field of fine cuboidal gamma prime precipitates surrounding the large barrier gamma prime precipitates.

Another advantage of the present invention is that the alloy has improved resistance to hydrogen embrittlement, particularly fatigue crack initiation and propagation.

The foregoing and other features and advantages of the present invention will become more apparent from the following description and accompanying drawings.

BEST MODE FOR CARRYING OUT THE INVENTION

The fatigue cracking of polycrystalline nickel base superalloys in a hydrogen environment is attributed to the initiation of fatigue cracks at the interfaces between the gamma and the gamma prime lamellae in the gamma—gamma prime eutectic islands and crack initiation at script-type carbides.

Figure 1:
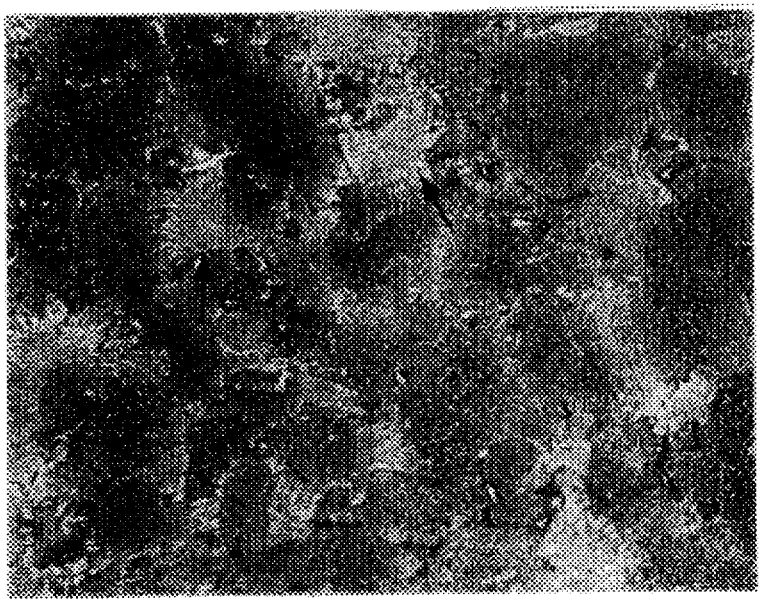
FIG. 1 is a photomicrograph of a prior art PWA 1489 microstructure showing the presence of gamma—gamma prime eutectic islands, as indicated by the arrows.
Figure 2:
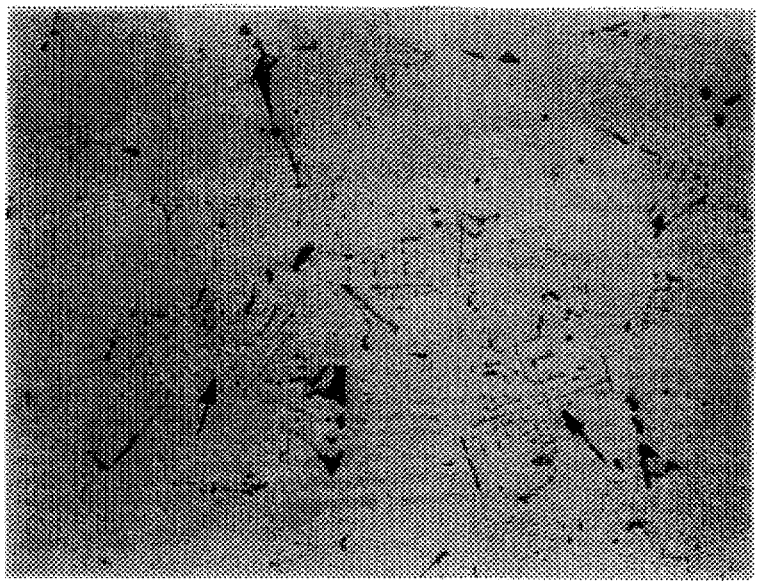
FIG. 2 is a photomicrograph of a prior art PWA 1489 microstructure showing the typical carbide morphology (presence of script type carbides, as indicated by the arrows).
Figure 3:
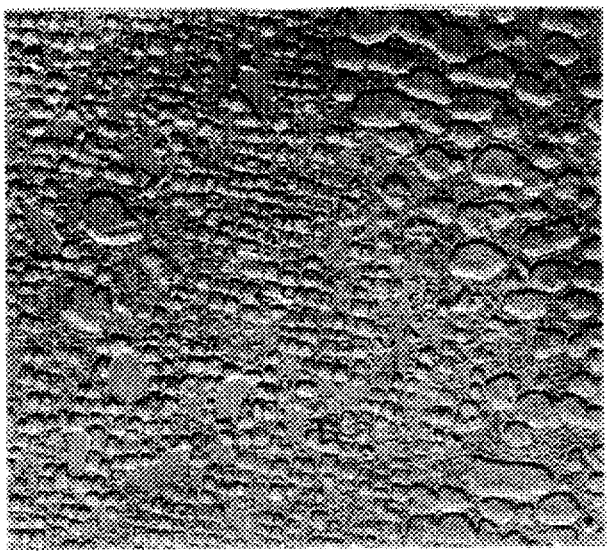
FIG. 3 is a photomicrograph of a prior art PWA 1489 microstructure showing the typical gamma prime morphology.

PWA 1489 is an equiaxed nickel base superalloy used primarily for components requiring high thermal shock resistance and high strength at cryogenic and elevated temperatures. In prior applications it has been vacuum melted and cast, HIPped and solution heat treated. FIG. 1 shows gamma—gamma prime eutectic islands and FIG. 2 shows script-type carbides present in PWA 1489 processed using prior techniques. FIG. 3 shows the corresponding gamma prime morphology. The superalloy of FIGS. 1–3 was thermally processed using the following parameters: HIP at 2165° F. (1185° C.) for 4 hours at 25 ksi (172 MPa); solutioned at 2165° F. (1185° C.) for two hours; rapid vacuum cooled to below 1000° F. (538° C.); precipitation heat treated at 1975° F. (1079° C.) for four hours; air cooled to room temperature; aged at 1600° F. (871° C.) for 20 hours; and air cooled to room temperature.

While the presence of script-type carbides and gamma—gamma prime eutectic islands in alloys such as PWA 1489 was acceptable for the high temperature gas turbine applications, cracking of engine test components in a hydrogen environment produced inherent design limitations. The elimination of script carbides and eutectic islands by thermal processing provides significant property improvement and greater design margin for components produced from these alloys for use in the space shuttle main engine program.

The essential elimination of these microstructure features requires solutioning the alloy at temperatures significantly above the gamma prime solvus temperature and can result in incipient melting due to the microstructural chemical inhomogenities incurred during solidification.

Thus, a ramp solution cycle is employed to permit heating as much as about 50° F. (28° C.) above the gamma prime solvus temperature. This permits sufficient solutioning to virtually eliminate all script type carbides and eutectic islands. Specifically, the ramp cycle includes the following: heat the superalloy article from room temperature to about 2000° F. (1093° C.) at about 10° F./minute (5.5° C./minute); ramp from about 2000° F. (1093° C.) to about 2240° F. (1227° C.) at about 2° F./minute (1.1° C./minute); ramp from about 2275° F. (1246° C.) to about 2285° F. (1252° C.) at about 0.1° F./minute (0.06° C./minute); and hold at about 2285° F. (1252° C.) for between about 3 hours to about 6 hours, preferably 4 hours.

We have developed a post-solution cool down cycle to allow precipitation of large, barrier gamma prime precipitates. We have found that employment of this slow cool down cycle results in large gamma prime precipitates which act as crack arrestors, significantly deterring crack propagation, should a crack occur. Specifically, the superalloy article is then cooled from about 2285° F. (1252° C.) to about 2135° F. (1168° C.) at about 0.5° F./minute (0.28° C./minute) and rapid vacuum cooled from about 2135° F. (1168° C.) to below about 1000° F. (538° C.). This slow cooling enables the production of a microstructure which is significantly resistant to crack propagation. This improvement will increase the useful life of the superalloy article.

After employment of the slow cooling step, the superalloy article is then hot isostatic pressed (HIPped) at about 2165° F. (1185° C.) +/– about 25° F. (14° C.) at about 25 ksi (172 MPa) for 4 hours to 8 hours (preferably 4 hours), precipitation heat treated at about 1975° F. (1079° C.) +/– about 25° F. (14° C.) for 4 hours to 8 hours (preferably 4 hours) and air cooled to room temperature. The article is then aged at between about 1400° F. (760° C.) and about 1600° F. (871° C.) (preferably at about 1600° F. (871° C.) +/– about 25° F. (14° C.) for between about 8 hours and about 32 hours (preferably 20 hours) and air cooled to room temperature.

It is noted that the temperatures for the heat treatment are selected relative to the gamma prime solvus temperature for the particular alloy, in this case PWA 1489, and are based on a gradient heat treat study for the particular heat of material. The solution cycle may include several ramps at decreasing rates of temperature rise (with or without intermediate periods of constant temperature rise), or a smoothly increasing curve with a gradually decreasing rate of temperature increase until the maximum solution temperature is achieved.

Figure 4:
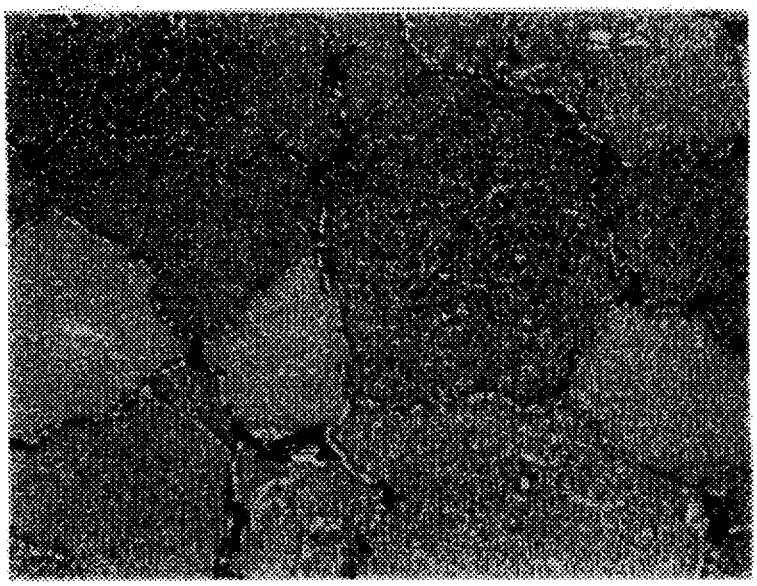
FIG. 4 is a photomicrograph of modified PWA 1489 microstructure of the present invention showing an absence of gamma—gamma prime eutectic islands.
Figure 5:
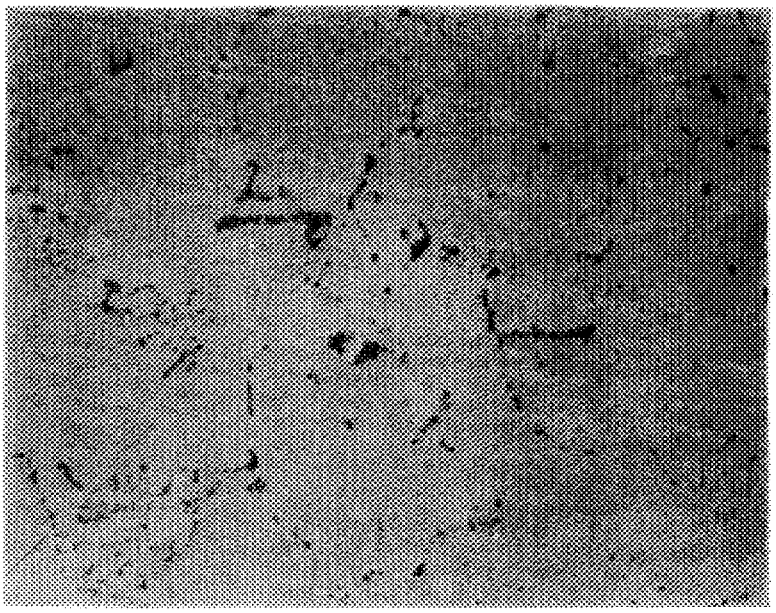
FIG. 5 is a photomicrograph of modified PWA 1489 microstructure of the present invention showing the typical carbide morphology (absence of script type carbides).
Figure 6:
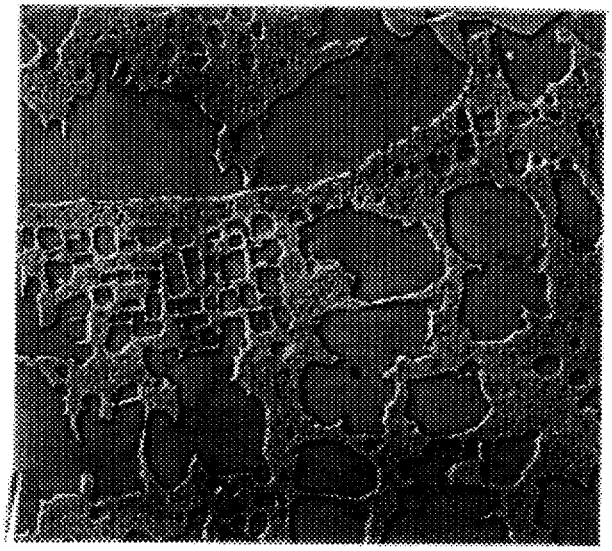
FIG. 6 is a photomicrograph of modified PWA 1489 microstructure of the present invention showing the gamma prime morphology (presence of larger, barrier gamma prime precipitates).

The microstructure of the invention-processed material is shown in FIGS. 4–6. The superalloy material of FIGS. 4–6 was thermally processed using the following parameters: solutioned at 2285° F. (1252° C.) for 4 hours; slow cooled to 2135° F. (1168° C.) at 0.5° F./minute (0.28° C./minute); rapid vacuum cooled from about 2135° F. (1168° C.) to below 1000° F. (538° C.); HIP at 2165° F. (1185° C.) for 4 hours at 25 ksi (172 MPa); precipitation heat treated at 1975° F. (1079° C.) for 4 hours; air cooled to room temperature; aged at 1600° F. (871° C.) for 20 hours; and air cooled to room temperature.

The advantages of the present invention can be readily seen from the figures. Specifically, FIG. 4 shows the absence of eutectic islands. FIG. 5 shows an absence of script type carbides. Most significantly, large, barrier gamma prime precipitates may be seen in FIG. 6. These large, barrier gamma prime precipitates significantly improve crack propagation resistance.

The microstructure of the present invention has an average grain size of from about 90 microns ($9\times10^{-5}$ m) to about 180 microns ($1.8\times10^{-4}$ m). The large gamma prime precipitates are between about 2 microns ($2\times10^{-6}$ m) and about 20 microns ($2\times10^{-5}$ m) and the fine cuboidal gamma prime precipitates surrounding the large barrier gamma prime precipitates are between about 0.3 microns ($3\times10^{-7}$ m) and about 0.7 microns ($7\times10^{-7}$ m). It should be noted that the grain size is set by the casting process employed.

The present invention will now be further described by way of example which is meant to be exemplary rather than limiting. Second stage vane ring segments with a nominal composition of 8.4 Cr, 10 Co, 0.65 Mo, 5.5 Al, 3.1 Ta, 10 W, 1.4 Hf, 1.1 Ti, 0.015 B, 0.05 Zr, balance Ni, with all quantities expressed in weight percent, were processed according to the present invention and tested in a hydrogen environment at 1600° F. (871° C.) and 5000 psi (34 MPa) for about 5000 seconds of run time. Several standard processed vane segments with the same composition were also tested for comparison. Following the test, the segments were fluorescent penetrant inspected. The segments processed according to the present invention showed no distress in comparison with the standard processed vane segments which exhibited trailing edge cracking.

Figure 8:
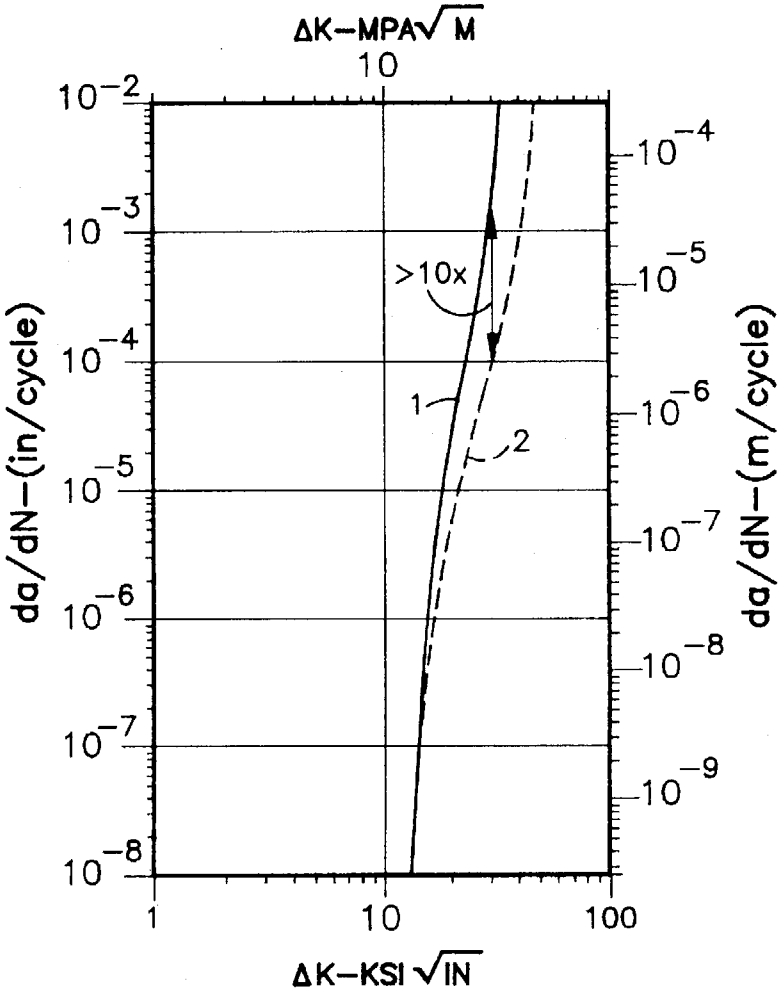
FIG. 7 and FIG. 8 are graphs (log—log plots) of fatigue crack growth rates (da/dN) at 1200° F. (649° C.)—FIG. 7; combination of 400° F. (204° C.) and 80° F. (27° C.)—FIG. 8; each at 5000 psig (35 MPa) as a function of stress intensity (ΔK) for conventionally processed PWA 1489 and modified PWA 1489 (processed according to the present invention).
Figure 7:
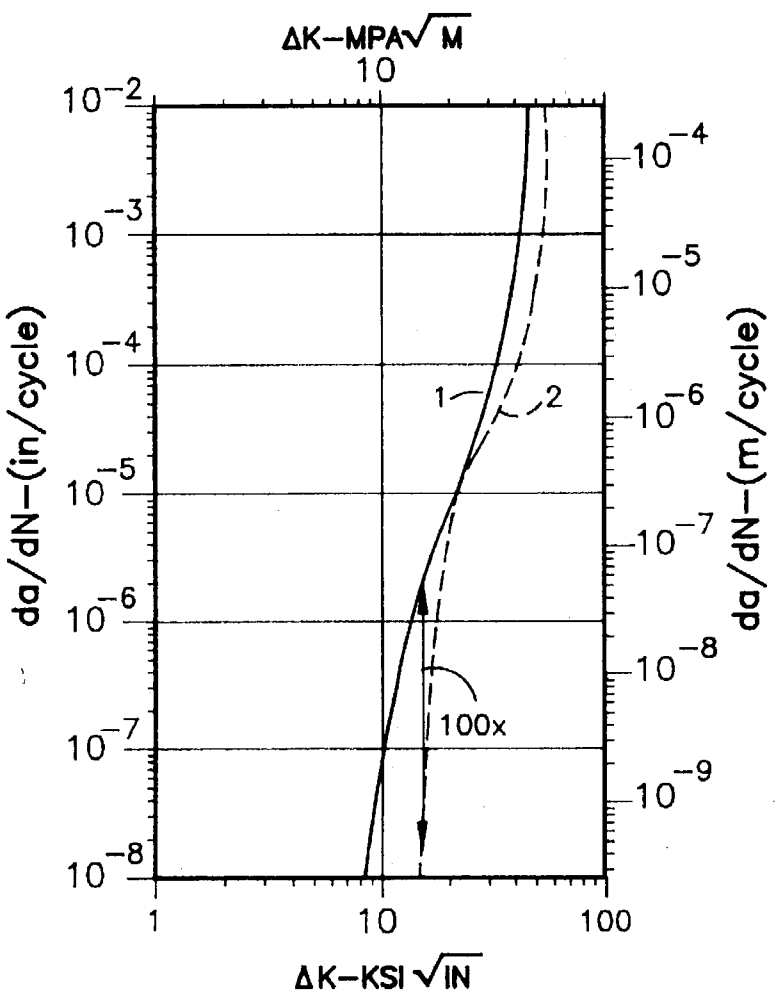

To further illustrate the advantages of the present invention, FIG. 7 and FIG. 8 are presented. These figures illustrate the rate of crack propagation for the prior microstructure of PWA 1489 compared to the new, modified microstructure of PWA 1489. Specifically, the axes of the graphs show how crack growth rate (da/dN) varies with stress intensity. The arrow in FIG. 7 shows how a crack in conventional PWA 1489 (indicated at 1) grows as much as a hundred times faster than a crack in modified PWA 1489 (indicated at 2) of the present invention. The arrow in FIG. 8 shows how a crack in conventional PWA 1489 (indicated at 1) can grow more than ten times faster than a crack in modified PWA 1489 (indicated at 2) of the present invention. The comparisons are made for tests conducted in high pressure hydrogen gas representing a rocket environment. Tests were conducted at 45 cycles per minute with zero hold time.

Although this invention has been shown and described with respect to detailed embodiments thereof, it will be understood by those skilled in the art that various changes, omissions and additions in form and detail thereof may be made without departing from the spirit and scope of the claimed invention.

We claim:

1. A nickel base, gamma prime precipitation strengthened alloy having an improved resistance to crack propagation, the alloy having a γ' solvus temperature and consisting essentially of:

| | (wt. %) range | (wt. %) |
|---|---|---|
| Carbon | 0.13 | 0.17 |
| Chromium | 8.0 | 8.80 |
| Cobalt | 9.00 | 11.00 |
| Molybdenum | 0.50 | 0.80 |
| Tungsten | 9.50 | 10.50 |
| Titanium | 0.90 | 1.20 |
| Aluminum | 5.30 | 5.70 |
| Tantalum | 2.80 | 3.30 |
| Hafnium | 1.20 | 1.6 |
| Iron | — | 0.25 |
| Columbium | — | 0.10 |
| Nickel | remainder | |

the alloy having a microstructure which is essentially free of script carbides, gamma—gamma prime eutectic islands and porosity, wherein the microstructure consists essentially of a plurality of regularly occurring large barrier gamma prime precipitates having a grain size between about 2 microns and about 20 microns and a continuous field of fine cuboidal gamma prime precipitates having a grain size between about 0.3 microns and about 0.7 microns surrounding the large barrier gamma prime precipitates, wherein said alloy is processed by: heat treating the alloy at a temperature sufficiently above its gamma prime solvus temperature to dissolve substantially all gamma—gamma prime eutectic islands and script carbides without causing incipient melting; cooling to about 2135° F. at between about 0.1° F./minute and about 5° F./minute; rapid vacuum cooling to below about 1000° F.; hot isostatic pressing the alloy to eliminate porosity; precipitation heat treating the alloy at about 1975° F. +/– about 25° F. for four hours; and air cooling the alloy to room temperature followed by aging.

2. The alloy as recited in claim 1 further characterized by a columnar grain structure.

3. The alloy as recited in claim 1 further characterized by an equiaxed grain structure.

4. The alloy as recited in claim 1 wherein the large barrier gamma prime precipitates are elongated in the <111> family of crystallographic directions.

5. A rocket turbo pump comprising a nickel base, gamma prime precipitation strengthened alloy having an improved resistance to crack propagation, the alloy having a γ' solvus temperature and consisting essentially of:

| | (wt. %) range | (wt. %) |
|---|---|---|
| Carbon | 0.13 | 0.17 |
| Chromium | 8.0 | 8.80 |
| Cobalt | 9.00 | 11.00 |
| Molybdenum | 0.50 | 0.80 |
| Tungsten | 9.50 | 10.50 |
| Titanium | 0.90 | 1.20 |
| Aluminum | 5.30 | 5.70 |
| Tantalum | 2.80 | 3.30 |
| Hafnium | 1.20 | 1.6 |
| Iron | — | 0.25 |

-continued

| | (wt. %) range | (wt. %) |
|---|---|---|
| Columbium | — | 0.10 |
| Nickel | remainder | |

the alloy having a microstructure which is essentially free of script carbides, gamma—gamma prime eutectic islands and porosity, wherein the microstructure consists essentially of a plurality of regularly occurring large barrier gamma prime precipitates having a grain size between about 2 microns and about 20 microns and a continuous field of fine cuboidal gamma prime precipitates having a grain size between about 0.3 and 0.7 microns surrounding the large barrier gamma prime precipitates, wherein said alloy is processed by: heat treating the alloy at a temperature sufficiently above its gamma prime solvus temperature to dissolve substantially all gamma—gamma prime eutectic islands and script carbides without causing incipient melting; cooling to about 2135° F. at between about 0.1° F./minute and about 5° F./minute; rapid vacuum cooling to below about 1000° F.; hot isostatic pressing the alloy to eliminate porosity; precipitation heat treating the alloy at about 1975° F. +/– about 25° F. for four hours; and air cooling the alloy to room temperature followed by aging.

6. A gas turbine engine component comprising a nickel base, gamma prime precipitation strengthened alloy having an improved resistance to crack propagation, the alloy having a γ' solvus temperature and consisting essentially of:

| | (wt. %) range | (wt. %) |
|---|---|---|
| Carbon | 0.13 | 0.17 |
| Chromium | 8.0 | 8.80 |
| Cobalt | 9.00 | 11.00 |
| Molybdenum | 0.50 | 0.80 |
| Tungsten | 9.50 | 10.50 |
| Titanium | 0.90 | 1.20 |
| Aluminum | 5.30 | 5.70 |
| Tantalum | 2.80 | 3.30 |
| Hafnium | 1.20 | 1.6 |
| Iron | — | 0.25 |
| Columbium | — | 0.10 |
| Nickel | remainder | |

the alloy having a microstructure which is essentially free of script carbides, gamma—gamma prime eutectic islands and porosity, wherein the microstructure consists essentially of a plurality of regularly occurring large barrier gamma prime precipitates having a grain size between about 2 microns and about 20 microns and a continuous field of fine cuboidal gamma prime precipitates having a grain size between about 0.3 microns and about 0.7 microns surrounding the large barrier gamma prime precipitates, wherein said alloy is processed by: heat treating the alloy at a temperature sufficiently above its gamma prime solvus temperature to dissolve substantially all gamma—gamma prime eutectic islands and script carbides without causing incipient melting; cooling to about 2135° F. at between about 0.1° F./minute and about 5° F./minute; rapid vacuum cooling to below about 1000° F.; hot isostatic pressing the alloy to eliminate porosity; precipitation heat treating the alloy at about 1975° F. +/– about 25° F. for four hours; and air cooling the alloy to room temperature followed by aging.

* * * * *